United States Patent [19]

Hänsch

[11] Patent Number: 5,052,666

[45] Date of Patent: Oct. 1, 1991

[54] DEVICE FOR PROCESSING PRINTED PRODUCTS

[75] Inventor: Egon Hänsch, Wetzikon, Switzerland

[73] Assignee: Ferag AG, Hinwil, Switzerland

[21] Appl. No.: 349,302

[22] Filed: May 9, 1989

[30] Foreign Application Priority Data

May 11, 1988 [CH] Switzerland ..... 01796/88

[51] Int. Cl.[5] ..... B65H 5/30

[52] U.S. Cl. ..... 270/55; 270/54

[58] Field of Search ..... 270/54, 55, 57, 58

[56] References Cited

U.S. PATENT DOCUMENTS 3,951,399 4/1976 Reist .
4,058,202 11/1977 Reist et al. .
4,398,710 8/1983 Hansch .
4,408,754 10/1983 Meier .
4,489,930 12/1985 Meier .
4,684,116 8/1987 Hansch .
4,684,117 8/1987 Honegger et al. .
4,706,951 11/1987 Leu .
4,709,910 12/1987 Honegger .
4,723,770 2/1988 Seidel ..... 270/57
4,735,406 4/1988 Weber .
4,743,005 5/1988 Reist ..... 270/55

FOREIGN PATENT DOCUMENTS 641113 2/1984 Switzerland .
2072631A 10/1981 United Kingdom ..... 270/54

*Primary Examiner*—John T. Kwon
*Assistant Examiner*—Therese M. Newholm
*Attorney, Agent, or Firm*—Willian Brinks Olds Hofer Gilson & Lione

[57] ABSTRACT

Each compartment of a drum for collation, insertion or collection of printed sheets (34) is allocated carriages (50), which in the course of a revolution in a direction of rotation (U) carry out a conveyance and a return stroke in or opposite to an arrow direction (F). Each carriage is provided with swiveling clamping tongues (54) which can be controlled by means of rail sections (56) running parallel to the direction of movement (F) of the carriages (50) and movable in a direction (H). In this way the clamping tongues (54) can be closed or opened irrespective of the position and speed of the carriages (50) in or opposite to the arrow direction (F).

20 Claims, 7 Drawing Sheets

DEVICE FOR PROCESSING PRINTED PRODUCTS

BACKGROUND OF THE INVENTION

The present invention relates to a device for processing, in particular for insertion, collation or collection, of printed products.

Such a device, with a star feeder rotating about an axis of rotation and having compartments running in the direction of the axis of rotation, is known from, for example, CH-PS 575,303 or the corresponding U.S. Pat. No. 4,058,202. Each compartment is allocated a carriage with controllable clamps which in the course of a revolution of the star feeder carries out a conveyance and a return stroke. In the lengthwise direction of the star feeder feed points are provided one after the other, at which printed products are introduced into the compartments and taken to the carriages for conveyance further to the next feed point or to the removal point disposed at the end of the star feeder, viewed in the direction of the conveyance stroke. Each carriage has mounted on it in pivoting fashion a shaft which runs in the lengthwise direction of the compartments and to which the clamping tongues of the clamps are fastened in a spring-loaded manner. The shaft has an actuation element projecting inwards in the radial direction, which runs onto a fixed closing link at the beginning of the conveyance stroke when the carriage is standing still in the direction of the conveyance stroke, thereby causing the shaft to swivel and the clamping tongues to be moved from their open position to their closed position. A freewheel operatively connected to the shaft prevents the shaft from swinging back towards the open position of the clamping tongues. The latter remain closed during the conveyance stroke of the carriage until at the point when the carriage is at a standstill at the end of the conveyance stroke an actuation element of the freewheel in the course of further turning of the star feeder runs onto an opening link, causing the freewheel to be released and the shaft to be swung back into the open position of the clamping tongues. This control device for the clamps is a very expensive design, and the opening and closing of the clamps is rigidly linked to the position of the carriage and the turning of the star feeder.

It is therefore the object of the present invention to produce a device of the type described initially above which is simpler in construction and can be adjusted by simple means.

SUMMARY OF THE INVENTION

According to this invention a device is provided for insertion, collation, or collection of printed products. The device of this invention comprises at least one carriage mounted to carry out a conveyance stroke along at least one processing line for conveying to a removal point printed products delivered at at least one feed point to the carriage. At least one releasable clamp is associated with the carriage and is movable between an opened and a closed position. This clamp is operative when closed to hold printed products during at least part of the conveyance stroke. Means are provided for controlling the clamp to move from the open to the closed position and vice versa independently of movement of the carriage.

The clamps can be controlled independently of the movement or the position of the carriage. Apart from being a simple mechanical construction, this also permits the most varied uses of the same device, for example for insertion, collation and collection of printed products. It should be remembered here that only a single processing line or several processing lines can be provided, along which the printed products are conveyed.

A particularly simple embodiment of the control device preferably has stationary control means, viewed in the direction of movement of the carriage, by means of which the closing and opening commands can be transmitted to the clamps, irrespective of the position and speed of the carriage.

A particularly simple control device has a rail section which can be moved crosswise to the direction of movement of the carriage and in which an actuation element for the clamps, disposed on the carriage, is guided. The actuation element can thus be actuated in a simple manner independently of the position of the carriage.

A preferred embodiment for the mounting and actuation of the rail section includes parallel rocking levers and associated control elements as described below.

A particularly high processing capacity can be achieved if a star feeder is equipped with carriages having clamps which can be controlled by means of the control device independently of the movement and position of the carriages.

In a particularly simple manner the clamps can be controlled through each rail section being operatively connected to a follower which slides on a fixed link, the clamps being controllable only as a function of the turning position of the star feeder. The uses and adjustability of the star feeder can be improved through the fact that this link can be exchanged for another link, or that it can be changed in position or shape.

Further advantageous features are described in the following detailed description, which describes an example of the invention in greater detail with reference to the drawings.

DETAILED DESCRIPTION OF THE PRESENTLY PREFERRED EMBODIMENTS

Figure 1:
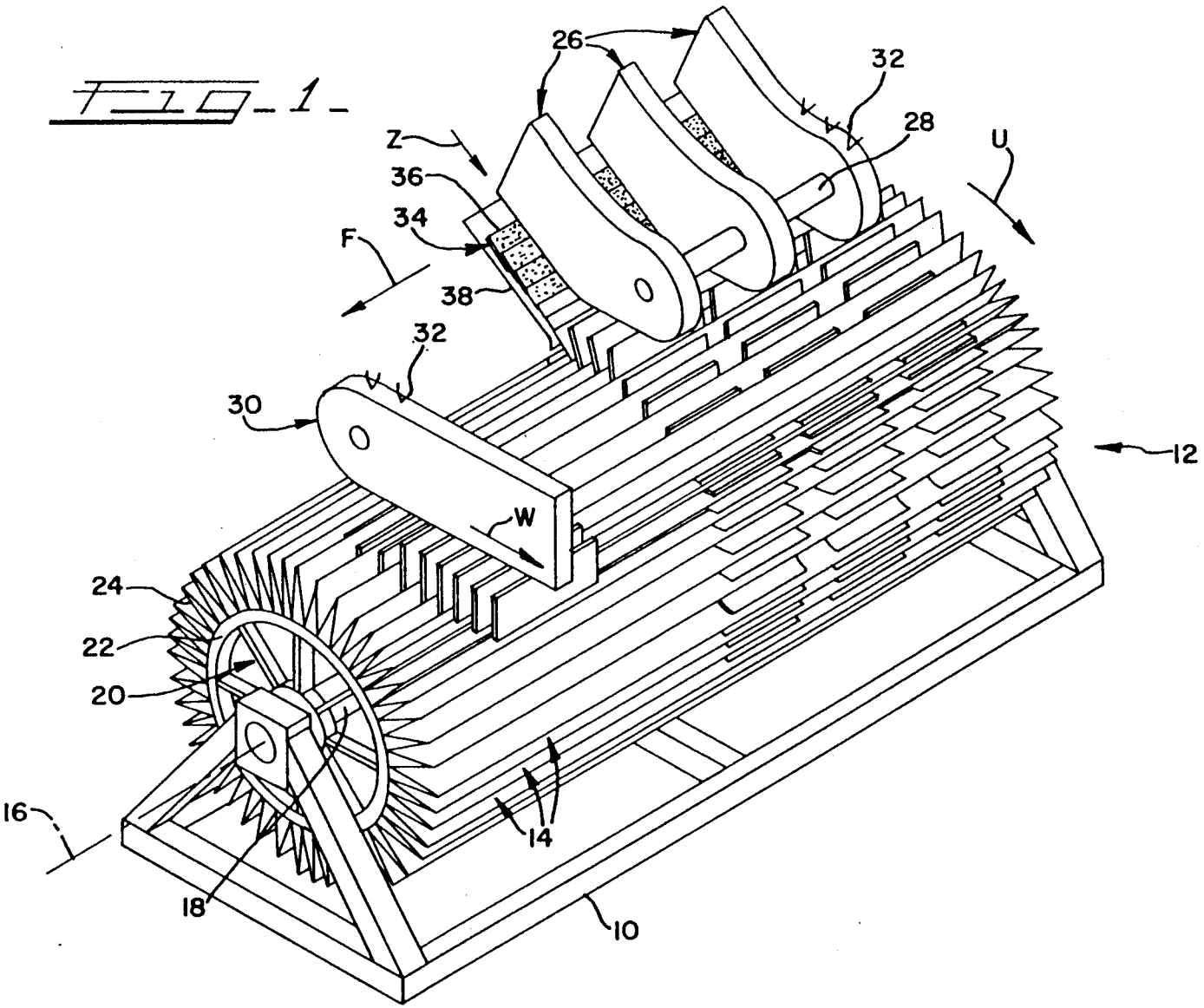
FIG. 1 shows a perspective view of an example of an embodiment of a collating drum.

FIG. 1 shows a rotary star feeder type of collating drum 12 pivoted on a frame 10 and having a multiplicity of pocket-shaped compartments 14 which extend in the lengthwise direction of the drum 12, and which rotate jointly about an axis of rotation 16 in the direction of the arrow U. The frame 10 has disposed on it a hollow shaft 18 whose longitudinal axis coincides with the axis of rotation 16. Rotatably mounted on the hollow shaft 18 are spoked wheels 20 spaced apart in the axial direction (only one of which can be seen in FIG. 1). Partitions 24, projecting radially outwards and running in the lengthwise direction of the drum 12, are fixed on the rims 22 of the spoked wheels 20 and separate the compartments 14 from each other, viewed in the direction of rotation U.

Three schematically shown feed conveyors 26, spaced apart in the direction of the axis of rotation 16, are provided above the drum 12 and can be driven in synchronism by means of a common drive shaft 28. A discharge conveyor 30, which is also shown only schematically, is disposed in an end area of the collating drum 12, viewed in the direction of the arrow F. The feed conveyors 26 have disposed on a traction element (not shown) rotating in the feed direction Z individually controllable grippers 32, which are also shown only schematically. Such feed conveyors 26 are generally known and can be constructed, for example, in the same way as or similar to the feed conveyors shown in EP-OS 0,218,872 or the corresponding U.S. Pat. No. 4,706,951. It would also be conceivable to design the feed conveyors 26 in the way disclosed in CH-PS 575,303 or the corresponding U.S. Pat. No. 4,058,202. Each of the grippers 32 conveyed to the collating drum 12 seizes a printed sheet 34 at its rear edge 36, viewed in the feed direction Z. A baffle plate 38, running essentially parallel to the feed direction Z, and disposed below the feed conveyor 26, is mounted before the drum 12 and inserts the leading edges of the printed sheets 34 sliding along it into the relevant compartments 14.

The discharge conveyor 30 also has grippers 32 disposed on a rotary traction element (not shown) which is driven in the discharge conveyance direction W, said grippers seizing and carrying away the collated printed sheets 34. A similar discharge conveyor is described in greater detail in, for example CH-PS 584,153 or the corresponding U.S. Pat. No. 3,951,399.

Each printed sheet 34 held by a gripper 32 of the feed conveyors 26 is fed by the baffle plate 38 into a compartment 14 of the collating drum 12 and is dropped by the gripper 32 once the latter has reached an approximately vertical position above the axis of rotation 16. The printed sheets thus dropped come to rest on the floor of the particular compartment 14. Thus, the first feed conveyor 26, viewed in the direction of the arrow F, conveys a printed sheet 34 into each compartment 14 passing below this feed conveyor 26 in the course of the revolutions of the drum 12 in the direction of rotation U. In the course of a revolution of the drum 12 these printed sheets 34 are conveyed in the direction of the arrow F along a spiral path to the next feed conveyor 26, which also feeds another printed sheet into each compartment 14 next to each printed sheet 34 already in it, and these are then in each case conveyed together in the course of the next revolution of the collating drum 12 to the next feed conveyor 26. This is repeated until, as shown in FIG. 1, for example, three printed sheets 34 are lying side by side. In the course of two further revolutions the printed sheets 34 thus collated are conveyed to the discharge conveyor 30, where they are seized by it and taken away. In the region between the feed conveyors 26 and the discharge conveyor 30 the printed sheets 34 lying side by side can be subjected to further processing operations as desired.

Figure 2:
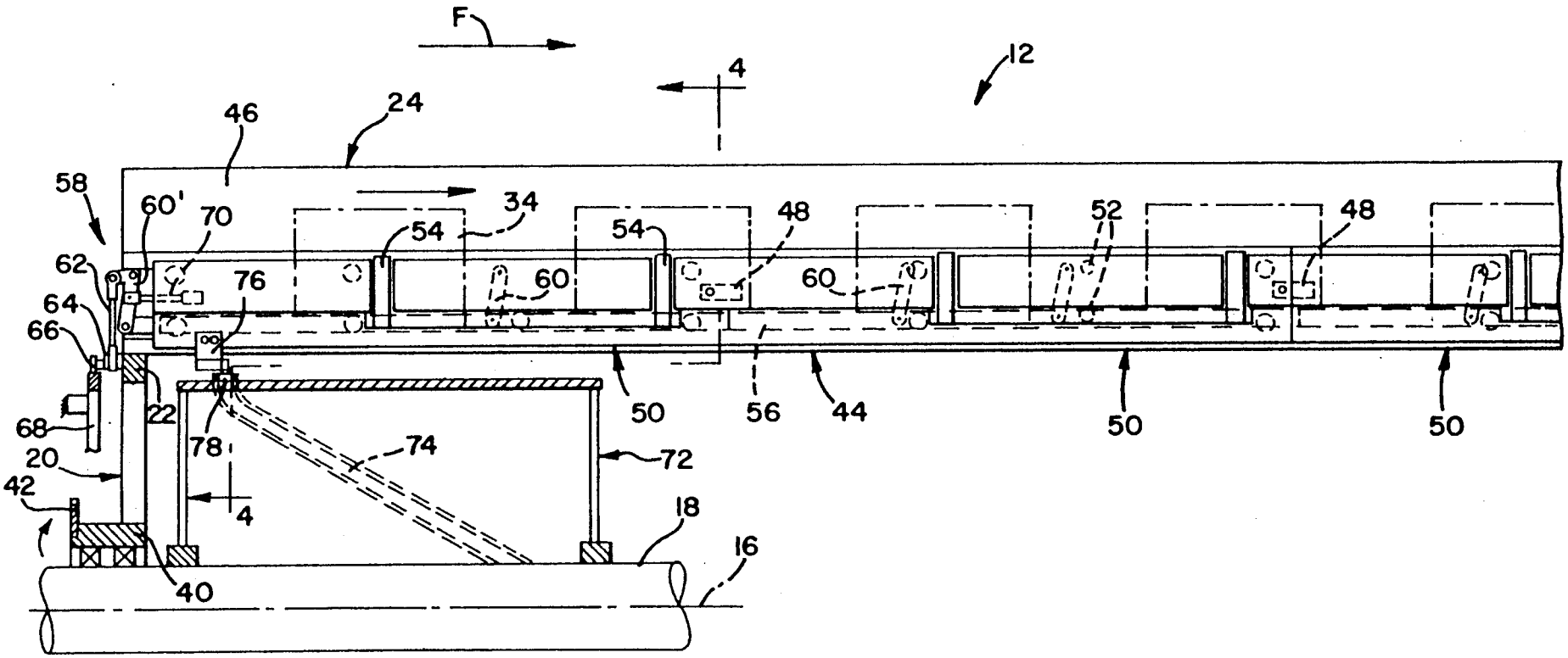
FIG. 2 shows a part of the collating drum in a longitudinal section.

FIG. 2 shows a part of the collating drum 12 in a longitudinal section. The one spoked wheel 20 visible in FIG. 2 is rotatably mounted on the hollow shaft 18, and has on its hub 40 a non-rotating chain wheel 42 of a chain drive which is operatively connected to a drive motor (not shown). The drum 12 is driven in the direction of rotation U by means of this drive motor (cf. FIG. 1). One end of a rail 44 which is C-shaped in cross section is fixed on the rim 22, said rail running in the lengthwise direction of the collating drum 12 and together with the support 46 fixed on it forming a partition 24. All partitions 24 shown in FIG. 1 are constructed in the same way as the partition 24 shown in FIG. 2. Three carriages 50 which are connected to each other by means of coupling elements 48, and which can be seen in this FIG. 2, are guided in the rail 44. Each carriage 50 has three or two guide roller pairs 52 which pivot thereon and run in the rail 44. Two clamping tongues 54 are mounted so that they swivel on each carriage 50, and they can be taken from their open position into the closed position and back by means of coupled rail sections 56 of a control device 58. This is described in greater detail further on.

Each rail section 56 is mounted, like a parallel crank gear, on two parallel rocking levers 60, which for their part are mounted in swivel fashion on the rail 44. The rocking lever shown on the left end of the rail 44 and indicated by 60' is designed as an angle lever and is operatively connected by means of a piston rod 62 to a twin-armed control lever 64 which is mounted in swivel fashion on the rim 22, and at the other end of which a follower roller 66 is rotatably mounted and for its part rolls along a guide face of a fixed link 68. A compression spring 70 fixed at one end to the rail 44 and acting at the other end on the rocking lever 60' presses the follower roller 66 against the guide face of the link 68 and at the same time pretensions the clamping tongues 54 towards the open position.

Viewed in the direction of the arrow F, provision is made in the initial area of the collating drum 12 for a coaxial control cylinder 72 which is disposed in a rotation-free manner on the usually stationary hollow shaft 18 and whose cylindrical surface, viewed in the radial direction, is a distance inwards from the rails 44. Disposed on the cylindrical surface is a self-contained control link 74, similar to an ellipse, which rotates about the control cylinder 72, and which, viewed in the direction of the axis of rotation 16, has in each of the end regions a sharp curve and between these end regions in each case a region with constant gradient as regards the direction of rotation U (in FIG. 2 only part of the control link 74 is shown).

Of all the carriages 50 guided in a rail 44 only the one in the region of the control cylinder 72 has a stirrup 76 by means of which it is connected to an adjacent carriage 50, viewed in the direction of rotation U. A carrier 78 disposed on the stirrup 76 runs in the control link 74 on the control cylinder 72. Dashed and dotted lines show printed sheets 34 standing in line on the bottom of the carriages 50, held fast by the clamping tongues 54 and, viewed in the direction of conveyance F, starting from the left, the first three printed sheets 34 shown in FIG. 2 essentially corresponding to the position of the feed conveyors 26 (cf. FIG. 1). In this way a single printed sheet 34 fed in by the first feed conveyor 26 is held fast by the first clamping tongue 54, in the case of the second clamping tongue 54 there are two identical adjacent printed sheets 34, the second one having been fed in by the second feed conveyor 26, and in the case of the third clamping tongue 54 there are three of them, the third one having been fed in by the third feed conveyor 26. Each of the subsequent clamping tongues 54 also clamps three each of the adjacent printed sheets 34.

Figure 3:
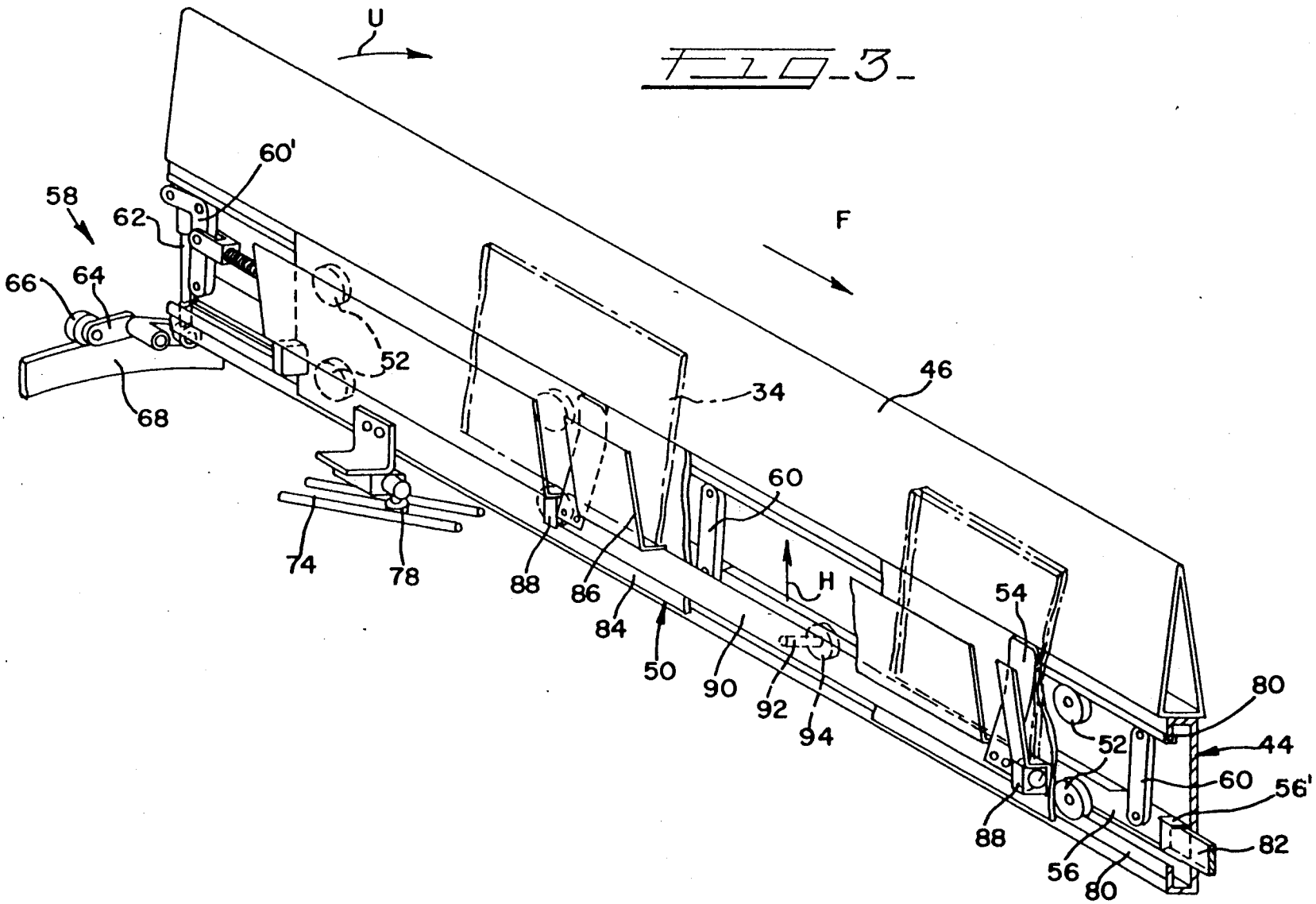
FIG. 3 shows a part of FIG. 2 in perspective, and simplified.

In FIGS. 3 part of the left half of FIG. 2 is shown in perspective and on an enlarged scale, the carriage 50 being shown partially cut away. The same parts are indicated by the same reference numbers as in FIG. 2. These are discussed only insofar as is necessary for understanding FIG. 3. The ends of the C-shaped rail 44 facing each other each have a guide profile 80, for example made of plastic. The rollers of the guide roller pairs 52 rotatably mounted on the carriage 50 are made concave, so that they partially grip the guide profile 80 and give the carriages 50 a certain hold in a direction at right angles to the rail 44. The rail 44 has rotatably mounted on it the rocking levers 60, 60', whose free ends are connected to the rail section 56 in such a way that they swivel. The rail section 56 is also C-shaped in cross section, in the region of the rocking levers 60, 60' the upper flank 56' being always excluded Reference number 82 indicates the connecting piece connecting the rail section 56 to the next rail section 56, viewed in the direction F. When the rocking levers 60, 60' are swung from the position shown in FIGS. 2 and 3 in the clockwise direction, the rail section 56 makes a movement like the couple of a parallel crank gear and thus also a stroke movement in the direction of the arrow H, i.e., in the radial direction outwards. This movement of the rail section 56 is controlled by the follower roller 66 sliding on the link 68, the movement of said roller being transmitted by means of the control lever 64 and the piston rod 62 to the rocking lever 60' designed as an angle lever.

The carriage 50 has a flat wall element 84 on which the guide roller pairs 52 are mounted. On the wall element 84, at the side facing away from the rail 44, there is provided an upward bent guide element 86 which forms a pocket with a bottom, and which is cut out in the region of the clamping tongues 54. The clamping tongues 54, which are preferably made of spring steel, are fixed to a shaft 90 swivelably mounted by means of bearing elements 88 on the wall element 84 and running in the lengthwise direction of the rail 44. The upward-projecting free ends of the clamping tongues 54 can bear clamping supports, for example made of rubber. A lever arm 92 projecting towards the rail section 6 is fixed on the shaft 90 approximately in the center, between the two clamping tongues 54, on the free end of which arm a roller 94 guided in the C-shaped rail section 56 is rotatably mounted. When the carriage 50 is moved in the direction of the arrow F or in the opposite direction the roller 94 slides in the rail section 56, and when the rail section 56 is raised or lowered in the direction of the arrow H or in the opposite direction the two clamping tongues 54 are swung into the open or closed position. During rotation of the rail 44 together with the support 46 and the carriage 50 in the direction of the arrow U the carriage 50 makes a conveyance stroke in the direction of the arrow F and in the opposite direction a return stroke according to the control link 74 in which the carrier 78 is sliding. In this figure also, as in FIG. 2, the individual printed sheets 34, or those deposited side by side on the bottom of the guide element 86, are shown by dotted and dashed lines (the printed sheets 34 shown on the right in FIG. 3 are shown cut off on the righthand side).

Figure 4:
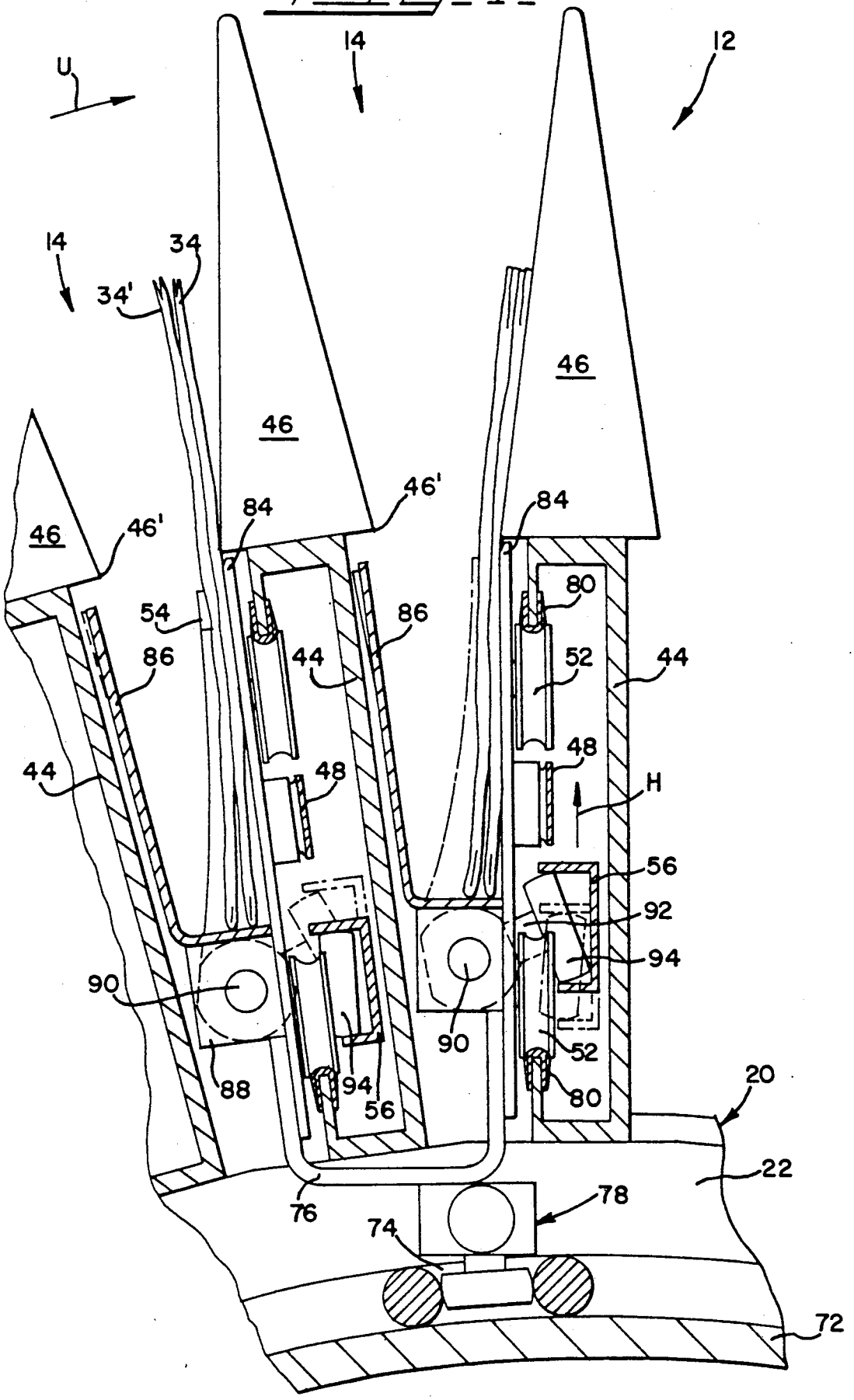
FIG. 4 shows an enlarged view of a section along line IV—IV of FIG. 2.

FIG. 4 shows a section along the line IV—IV of FIG. 2 through several compartments 14 of the collating drum 12 (cf. FIG. 1). The rails 44 are fixed on the rim 22 of the spoked wheel 20 (see FIGS. 1 and 2), and the supports 46 which are saddle-shaped in cross section rest on them directed radially outwards Disposed on the opposite-facing ends of each rail 44 are the guide profiles 80, on which the guide roller pairs 52 are guided. The guide roller pairs 52 are rotatably mounted on the relevant wall element 84, and the guide element 86 and the bearing elements 88, only one of which can be seen in FIG. 4, are fixed on said wall element. It should be noted that the upper end of the guide element 86, viewed in the direction of rotation U, extends behind the leading edge 46' of the following support 46. The upper end of the wall element 84 is also covered by the corresponding support 46, so that the printed sheets 34, 34' when inserted into the pocket formed by the wall element 84 and the guide element 86 can come to rest without any problem on its bottom and thus in the region of the clamping tongues 54. The clamping tongues 54 are fixed on the shafts 90 fitted on the bearing elements 88, from which shafts the lever arms 92 project towards the rail sections 56. Rotatably mounted on the free end of each lever arm 92 is a roller 94 which is guided in the appropriate rail section 56, and has a convex bearing surface. The suspension and actuation devices for the rail sections 56 are not shown in this figure. The rail section 56 shown on the right in FIG. 4 is in arrow direction H in the upper outer end position, in the radial direction, so that the clamping tongues 54 concerned are in their open position, in which the free ends of the clamping tongues 54, viewed in the direction of rotation U, come to rest behind the guide element 86. The rail section 56 shown in this figure on the left is in the lower, radially inner end position opposite to the direction of the arrow H, so that the appropriate clamping tongues 54 are taken into the closed position, in which they clamp the printed sheets 34 between them and the end stop formed by the wall element 84. The opposite positions of the clamping tongues 54, rails 44 and rollers 94 are indicated by dashed and dotted lines in each compartment 14.

It should be noted that the two carriages 50 shown in this FIG. 4 are operatively connected to each other by means of the stirrup 76, but that the rail sections 56 of these two carriages 50 can be controlled independently of each other. It can be seen particularly clearly from this figure that the carrier 78 has a roller which is guided on two round profiles which are disposed parallel to each other on the control cylinder 72, and have a circular cross section, and whose opposite-facing surfaces form the control link 74. Reference number 48 indicates the coupling elements by means of which the carriages 50 guided in a rail 44 are coupled together (cf. FIG. 2).

Figure 5:
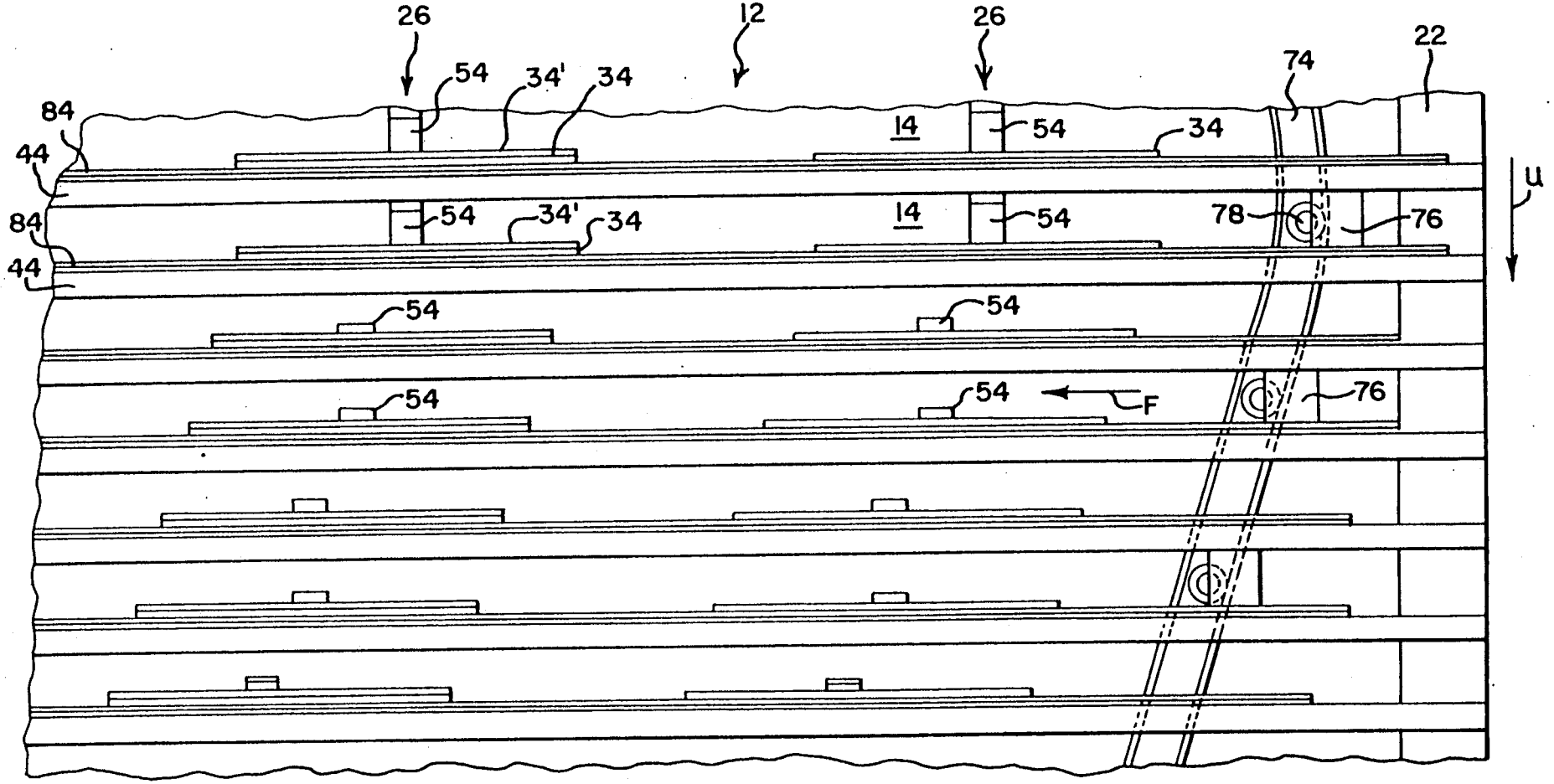
FIG. 5 shows the layout of a part of the conveyance route of the printed sheets.

FIG. 5 shows the layout of that part of the conveyance route of the printed sheets 34, 34' which, viewed in the direction of rotation U, follows the first two feed conveyors 26 in the direction of the arrow F in FIG. 1. In FIG. 5 these two feed conveyors are indicated by arrows 26. For the sake of a better overall view, the layout of the collating drum 12 is shown greatly simplified. For example, the supports 46 disposed on the rails 44 are not shown. Likewise, only the wall elements 84 and clamping tongues 54 of the carriages 50 are shown. On the stirrups 76 connecting every two carriages 50 or their wall elements 84 to each other the carriers 78 which slide in the fixed control link 74 are shown. It should be noted that the clamping tongues 54 of the wall elements 84 connected in each case by means of a stirrup 76, viewed in the direction of the arrow F, are at the same height. The direction of rotation is indicated by U.

The collating drum 12 shown in FIGS. 1 to 5 works as follows: the first feed conveyor 26, viewed in the direction of the arrow F, conveys a printed sheet 34 into each compartment 14 passing below it in the direction of the arrow U. When the clamping tongues 54 are in the open position this sheet falls onto the floor of the relevant carriage 50. In the course of further rotation in the direction of the arrow U the clamping tongues 54 are taken into the closed position, which causes the printed sheet 34 in question to be clamped between the clamping tongue 54 and the wall element 84 and to be carried along in the conveyance direction F according to the control link 74. A spiral conveyance route is thus formed to the next feed conveyor 26, and the conveyance stroke takes place in the direction of the arrow F essentially while the lower half of the conveyance route is being passed through (cf. FIG. 1). As soon as a compartment 14 reaches the upper region of the trajectory in the course of a revolution, the appropriate clamping tongues 54 are taken into the open position and the return stroke opposite to arrow direction F is introduced for the carriages 50 in question. On further rotation of the collating drum 12 in the direction of arrow U these printed sheets 34 the latter deposits a second printed sheet 34' into each compartment next to the printed sheets 34 already present (see in particular FIG. 5). The two printed sheets 34, 34' thus next to each other are now gripped in the course of further rotation by the closing clamping tongues 54, and in the course of a revolution are conveyed to the third feed conveyor 26, where in a similar manner a third printed sheet 34 is added. In the course of two further revolutions in the direction of arrow U these three printed sheets 34, 34' lying next to each other in each case are conveyed to the discharge conveyor 30, where they are seized by the grippers 32 and carried away in the direction of the arrow W (cf. FIG. 1).

In order to be certain to prevent the printed sheets 34, 34' from being carried along in the opposite direction to the arrow F during the return stroke of the carriages 50, provision can be made in each compartment 14, for example on the supports 46, for swivel-mounted arms which during conveyance of the printed sheets 34, 34' in the direction of the arrow F are swung back by said sheets, but which in the case of any movement of the printed sheets 34, 34' opposite to the direction of the arrow F stand in their way. Such arms are known, for example from CH-PS 575,303 or the corresponding U.S. Pat. No. 4,058,202 already mentioned above. It should be noted that during collation the printed sheets 34, 34' may be folded or not folded. It is also possible for the printed sheets 34, 34' fed in by one feed conveyor 26 to be folded, and the printed sheets 34, 34' fed in by another not to be folded.

Each of the printed sheets 34 and 34' shown in FIGS. 1 to 4 are made up of several folded single sheets, which are fed fold first to the collating drum 12.

Figure 6:
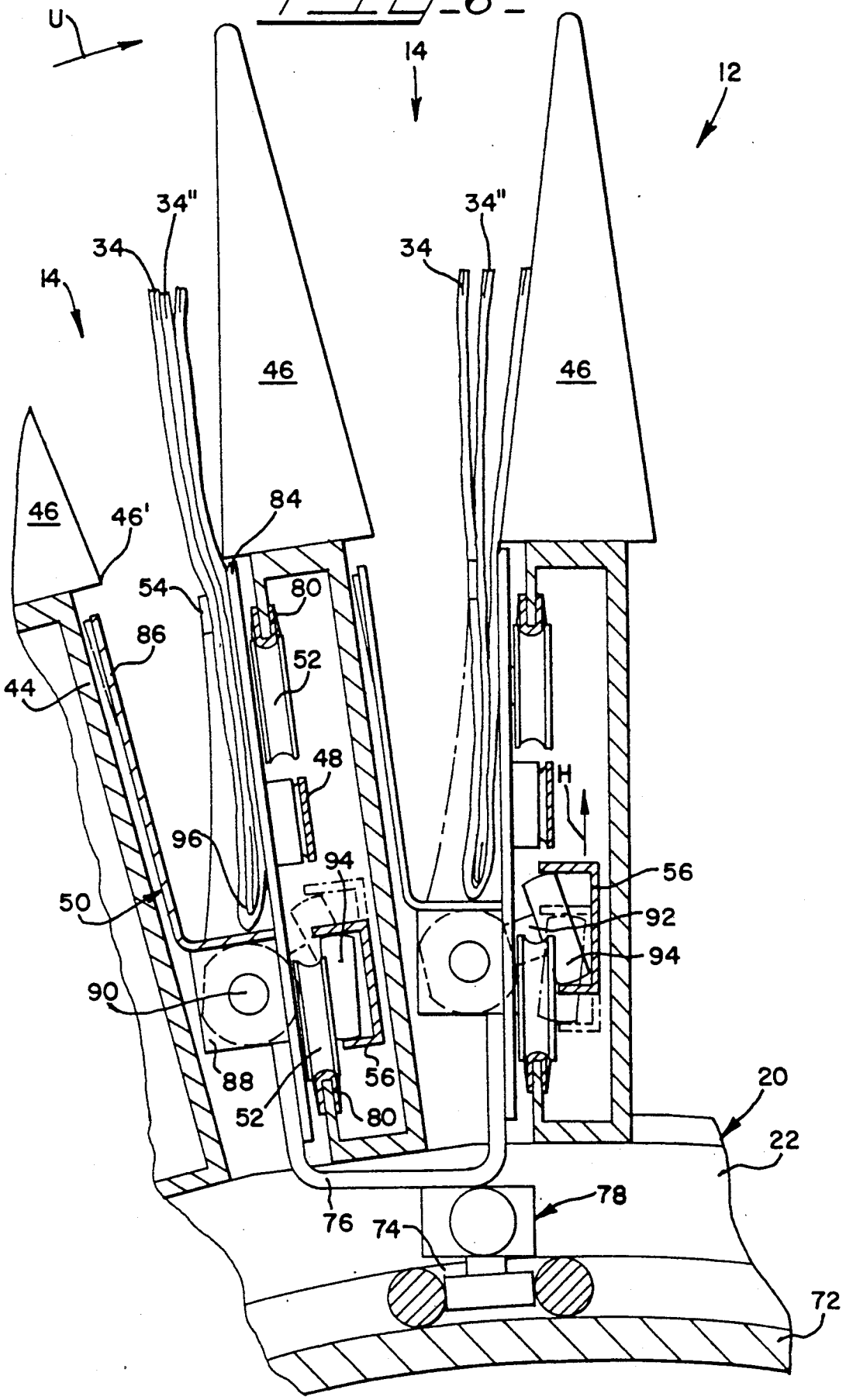
FIGS. 6 and 7 show an insertion or collection drum in the same view as FIG. 4.

FIG. 6 shows the same drum 12 in the same way as in FIG. 4, but here further printed sheets 34'' are inserted into a folded printed sheet 34 fed in first. In this case it is therefore an insertion drum 12 which is involved. For the detailed description of this FIG. 6 you are referred to FIG. 4 and the description of it, since the layout of the device in these two figures is the same. In a similar manner to the collating drum 12 described further back, the insertion drum 12 (FIG. 6) operates as follows: the first feed conveyor 26 (FIG. 1), viewed in the direction of the arrow F, conveys a folded printed sheet 34, fold 96 (FIG. 6) first, into each compartment 14. When the grippers 32 open, the printed sheet 34 falls onto the floor of the compartment 14 formed by the guide element 86, while the clamping tongues 54 are in the open position. In the course of further rotation in the direction of rotation U the appropriate clamping tongues 54 are taken into the closed position, before the appropriate compartment runs into the lower half of the trajectory, so that the folded printed sheet 34 is held fast between the wall element 84 and a clamping tongue 54. While the lower half of the trajectory is being passed through, the carriage 50 is conveyed together with the printed sheets 34 in the direction of arrow F into the region of the second feed conveyor 26 (see FIG. 1). In the course of this conveyance movement the folded printed sheets 34 are opened by means of an opening device of the type described in, for example, CH-PS 641,113 or CH-PS 644,814 or the corresponding U.S. Pat. No. 4,398,710. When they enter the appropriate compartment 14 again in the region of the upper half of the trajectory, the clamping tongues 54 are opened, and a printed sheet 34'', which may or may not be folded, is then inserted into the opened, folded printed sheet 34 by the second feed conveyor 26. In the course of the next revolution the printed sheets 34, 34'' thus inserted into each other are held fast by the clamping tongues 54 and conveyed to the third feed conveyor 26, where in a similar manner a second printed sheet 34'' is inserted. This second sheet 34'' can be inserted into the folded printed sheet 34 either beside or in the also opened first sheet 34''. The printed sheets 34, 34'' thus inserted into each other are conveyed in the course of two further revolutions in arrow direction U to the discharge conveyor 30, where they are seized by its grippers 32 and transported away. As in the case of the collating drum, the insertion drum 12 can also be provided with arms, in order to prevent the printed sheets 34, 34'' from running back in the opposite direction to arrow F during the return stroke of the carriages 50.

Figure 7:
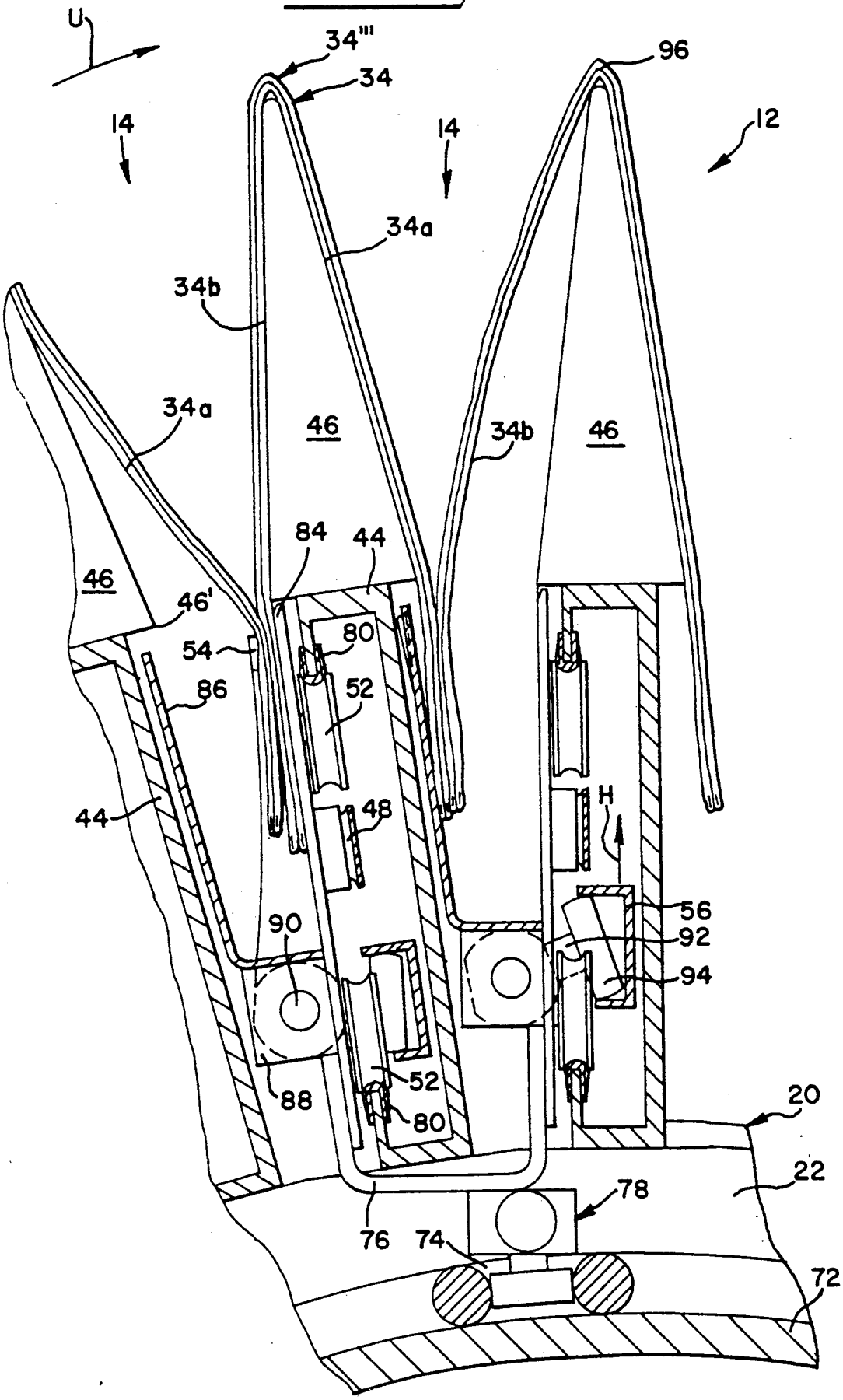

FIG. 7 shows another possible application of the drum 12, namely for the collection of folded printed sheets 34, 34'''. The layout of the drum 12 used as a collection drum corresponds to the layout of the collating drum shown in FIG. 4. For the detailed description of FIG. 7 you are therefore referred to FIG. 4. A detailed description of this collection drum 12 and the way in which it works can be found in the contemporary Swiss Patent Application No. 01 795/88-0. From the first feed conveyor 26, viewed in the direction of the arrow F shown in FIG. 1, a folded printed sheet 34 is placed astride each support 46, in the same or a similar manner as that known from, for example, EP-OS 0,208,081 or the corresponding U.S. Pat. No. 4,684,117, so that each printed sheet half **34*a* or 34*b* comes to rest in a compartment 14. Each printed sheet 34 is thus now held and conveyed by its printed sheet halves 34*a*, 34*b* by one carriage 50 disposed in different compartments 14**.

When the clamping tongues 54 of a carriage 50 close, the rear printed sheet half **34*b* of the printed sheet 34 deposited on the appropriate support 46 and the front printed sheet half 34*a* of the rear printed sheet 34, viewed in arrow direction U, are clamped. This never takes place until the two carriages 50 holding the same printed sheet 34 are running at the same speed in arrow direction F. The printed sheet 34 thus held for only a short time only by its leading printed sheet half 34a is thus carried along in arrow direction F and staggered in relation to the printed sheet 34 following it, so that a zigzag line of staggered printed sheets 34 is formed, and these are taken together to the second feed conveyor 26. Before the particular compartment 14 reaches the second feed conveyor 26, the appropriate clamping tongues 54 are opened, causing the staggered printed sheets 34 to be directed again in a similar manner, so that the second feed conveyor 26 can again deposit a folded printed sheet 34''' on the printed sheet 34 already deposited on the support 46. The printed sheets 34, 34''' thus lying on top of each other are now clamped by their leading and subsequently also by their rear printed sheet halves 34a and 34b respectively, and in the course of the next revolution are conveyed to the next feed conveyor 26, where a third printed sheet 34''' is placed astride the first two. In the course of the next revolutions in the direction of rotation U the printed sheets 34, 34''' thus collected are conveyed to the discharge conveyor 30, where they are seized by their folded edges 96** and conveyed away.

The opening device required for the insertion of printed sheets 34'' into a first folded printed sheet 34 (FIG. 6) and the arms which prevent the printed sheets 34, 34'' from being carried along in the opposite direction to arrow F on the return stroke of the carriages 50 can be fixed on the drum 12, and the opening device in particular must be designed in such a way that it does not act upon the printed sheets 34, 34'' during collation or collection. For example, opening devices could thus be disposed on the supports 46 in such a way that they can be swung back into the supports 46. It is, however, also conceivable for the opening devices and/or arms to be detachably disposed on the drum 12, so that the drum 12 can be changed within short changeover times to collation, insertion or collection.

It should be noted in particular that the carriages 50 and control device 58 are designed in the same way for all processing purposes. In particular, the independence of the control device 58 from the drive device 72, 74, 76, 78 permits adjustment at little expense of the closing or opening of the clamping tongues 54 as regards the movement or position of the carriages 50. For example, for insertion or collation of printed sheets 34, 34', 34'' the clamping tongues 54 can be closed when the carriages 50 are still stationary, viewed in the direction of conveyance F, while for collection the clamping tongues 54 of a carriage 50 may not be closed until this carriage 50 is running at the same speed as the leading carriage 50, viewed in the direction of the arrow U, otherwise the printed sheets 34, 34''' could be damaged. This adjustment of the opening or closing of the clamping tongues 54 can be achieved by, for example, changing the link 68. It is, however, also possible for the link 68 to be designed in such a way that its guide face can be varied. For example, provision could be made for link elements which move along the link 68, onto or off which the follower roller 66 runs.

The conveyance or return stroke of the carriages 50 can also be adjusted by swiveling the hollow shaft 18.

The drum 12 (see FIG. 1) can be made up of sections, viewed in the direction of the arrow F. It is, for example, entirely conceivable for the drum 12 shown in FIG. 1 to have such further sections attached to it, in the opposite direction to arrow F, that more than three printed sheets 34, 34', 34'', 34''' are collated, collected or inserted.

It is, of course, also conceivable for each printed sheet 34, 34', 34'', 34''' to be held fast by more than one clamping tongue 54. It is also conceivable for each feed conveyor 26 to feed in several printed sheets 34, 34', 34'' or 34''' disposed inside each other.

The rail sections 56 can also be designed, for example, in an L shape, in particular if the lever arms 92 are pretensioned in a swivel direction and are pressing the rollers 94 against the one flank of the rail sections 56.

The movement of the rail sections 56 can also be in a direction other than the radial direction H. It only has to be directed crosswise to the direction of movement of the carriages 50.

Furthermore, the feed conveyors 26 could be replaced by known feeders which feed the printed sheets 34, 34', 34'', 34''' to the supports 46 or compartments 14.

I claim:

1. A device for insertion, collation or collection of printed products comprising:

at least one carriage mounted to carry out a conveyance stroke along at least one processing line for conveying to a removal point printed products delivered at at least one feed point to the carriage, said at least one carriage defining a lengthwise direction and said conveyance stroke oriented along the lengthwise direction;

at least one releasable clamp associated with the carriage and movable between an open and a closed position, said clamp operative when closed to hold printed products during at least part of the conveyance stroke; and means for controlling the clamp to move from the open to the closed position and vice versa independently of movement of the carriage along the lengthwise direction.

2. The invention of claim 1 wherein the control means comprises a control element extending parallel to the conveyance stroke and operative to transmit opening and closing commands to the clamp.

3. The invention of claim 1 wherein the device further comprises means for driving the at least one carriage to carry out the conveyance stroke and a return stroke between at least two processing stations adjacent to each other, and wherein the controlling means opens the clamp before the start of the return stroke.

4. A device for insertion, collation or collection of printed products comprising:

at least one carriage mounted to carry out a conveyance stroke along at least one processing line for conveying to a removal point printed products delivered at least one feed point to the carriage, said at least one carriage defining a lengthwise direction and said conveyance stroke oriented along the lengthwise direction;

at least one releasable clamp associated with the carriage and movable between an open and a closed position, said clamp operative when closed to hold printed products during at least part of the conveyance stroke; and means for controlling the clamp to move from the open to the closed position and vice versa independently of movement of the carriage along the lengthwise direction;

wherein the control means comprises a control element extending parallel to the conveyance stroke and operative to transmit opening and closing commands to the clamp and;

wherein the control element comprises at least one rail section oriented parallel to the conveyance stroke and movable in a direction crosswise to the conveyance stroke; and wherein the clamp comprises an actuation element mounted on the carriage to track along the rail section.

5. The invention of claim 4 wherein the at least one clamp comprises a plurality of clamps, each of which is coupled to the actuation element to be operated thereby.

6. The invention of claim 4 wherein the at least one carriage comprises a plurality of carriages coupled together, and wherein the at least one rail section comprises a plurality of rail sections operatively connected together.

7. The invention of claim 6 wherein the plurality of rail sections are sections of a single rail.

8. The invention of claim 5 wherein the plurality of clamps comprise a plurality of clamping tongues fixed on a common shaft which is rotatable about a swiveling axis oriented substantially parallel to the conveyance stroke, and wherein the actuation element comprises a lever arm coupled to the shaft and having a free end guided on the rail section.

9. The invention of claim 8 wherein the rail section is C-shaped in cross section, and wherein the lever arm comprises a guide element at the free end, said guide element guided in the rail section.

10. The invention of claim 9 wherein the guide element comprises a roller rotatably mounted on the lever arm.

11. The invention of claim 4 wherein the at least one carriage is guided in the conveyance stroke by at least one guide rail, and wherein one of the guide rail and rail section is mounted on at least two rocking levers of equal length such that said one of the guide rail and rail section is movable to transmit opening and closing commands to the clamp.

12. A device for insertion, collation or collection of printed products comprising:

a rotary cell wheel having a plurality of accommodation devices running parallel to an axis of rotation defined by the wheel for reception of printed products, said wheel having at least one feed point and one removal point spaced along the axis of rotation;

a plurality of carriages mounted on the wheel to carry out a conveyance and a return stroke along a lengthwise direction of the accommodation devices, each carriage having at least one releasable clamp movable between an open and a closed position, said clamps operative when closed to hold printed products during at least part of the conveyance stroke; and means for controlling the clamps to move from the open to the closed position and vice versa independently of movement of the carriage;

the printed products being delivered at the feed point to the accommodation devices, being processed while in the accommodation devices, and being removed from the accommodation devices at the removal point.

13. The invention of claim 12 wherein the control means comprises a plurality of control elements extending parallel to the conveyance stroke and operative to transmit opening and closing commands to the clamps.

14. The invention of claim 13 wherein the control elements comprise a plurality of rail sections, each oriented parallel to the conveyance stroke and movable in a direction crosswise to the conveyance stroke; and wherein each of the clamps is coupled to a respective actuation element mounted to track along the respective rail section during movement of the respective carriage.

15. The invention of claim 14 wherein a plurality of the clamps each comprise a plurality of clamping tongues fixed on a common shaft which is rotatable about a swiveling axis oriented substantially parallel to the conveyance stroke, and wherein the respective actuation element comprises a lever arm coupled to the shaft and having a free end guided on the respective rail section.

16. The invention of claim 14 or 15 wherein each rail section is operatively connected to a follower which slides on a fixed link to control positioning of the clamps depending on the rotational position of the cell wheel.

17. The invention of claim 16 wherein the fixed link is adapted for alteration to alter positioning of the clamps.

18. The invention of claim 14 wherein the carriages associated with selected adjacent accommodation devices are coupled together.

19. The invention of claim 14 wherein the accommodation devices comprise pocket-shaped compartments, and the printed products are fed into the compartments at the feed points.

20. The invention of claim 14 wherein the accommodation devices comprise saddle-shaped supports, and the printed products are deposited astride the supports at the feed points.

* * * * *

UNITED STATES PATENT AND TRADEMARK OFFICE

CERTIFICATE OF CORRECTION

PATENT NO. : 5,052,666

DATED : October 1, 1991

INVENTOR(S) : Egon Hänsch

It is certified that error appears in the above-identified patent and that said Letters Patent is hereby corrected as shown below:

In column 5, line 17, after "excluded" please insert --.--.

In column 5, line 43, after "section" please delete "6" and substitute therefor --56--.

In column 6, line 1, after "outwards" please insert --.--.

In column 7, line 26, after "34" please insert --therefore arrive at the second feed conveyor 26, where--.

Signed and Sealed this

Thirteenth Day of July, 1993

*Attest:*

*Attesting Officer*

Michael K. Kirk

MICHAEL K. KIRK

*Acting Commissioner of Patents and Trademarks*